US010258083B2

(12) United States Patent
Batista

(10) Patent No.: US 10,258,083 B2
(45) Date of Patent: Apr. 16, 2019

(54) SMOKING ARTICLE COMPRISING A FRICTION IGNITABLE COMBUSTIBLE CARBONACEOUS HEAT SOURCE

(71) Applicant: Philip Morris Products S.A., Neuchatel (CH)

(72) Inventor: Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 16 days.

(21) Appl. No.: 15/525,957

(22) PCT Filed: Nov. 23, 2015

(86) PCT No.: PCT/EP2015/077397
§ 371 (c)(1),
(2) Date: May 11, 2017

(87) PCT Pub. No.: WO2016/079342
PCT Pub. Date: May 26, 2016

(65) Prior Publication Data

US 2017/0318859 A1 Nov. 9, 2017

(30) Foreign Application Priority Data

Nov. 21, 2014 (EP) ..... 14194370

(51) Int. Cl.
*A24F 47/00* (2006.01)
*A24D 1/08* (2006.01)
(Continued)

(52) U.S. Cl.
CPC ..... *A24F 47/004* (2013.01); *A24D 1/08* (2013.01); *A24F 47/006* (2013.01); *B65D 85/109* (2013.01); *F23Q 1/02* (2013.01)

(58) Field of Classification Search
CPC ..... A24F 47/004
See application file for complete search history.

(56) References Cited

U.S. PATENT DOCUMENTS 2,004,394 A 6/1935 Rowe
5,020,548 A * 6/1991 Farrier ..... A24B 15/165 128/202.21
(Continued)

FOREIGN PATENT DOCUMENTS

CN 203563685 U 4/2014
EP 0 627 174 A1 12/1994
(Continued)

OTHER PUBLICATIONS

Resonna Shaw, "How to Light a Match With No Striking," eHow, Oct. 9, 2014, pp. 1-2.
(Continued)

*Primary Examiner* — James Harvey
(74) *Attorney, Agent, or Firm* — Oblon, McClelland, Maier & Neustadt, L.L.P.

(57) ABSTRACT

A smoking article is provided, including a combustible carbonaceous heat source having opposed front and rear end faces; an aerosol-forming substrate downstream of the rear end face of the combustible carbonaceous heat source; an ignitable composition provided on at least a portion of the front end face of the combustible carbonaceous heat source; and one or more airflow pathways along configured to allow air to be drawn through the smoking article for inhalation, the ignitable composition being configured to be ignited by striking the front end face on a frictional surface, and being isolated from the one or more airflow pathways such that air drawn along the one or more airflow pathways does not directly contact the ignitable composition.

15 Claims, 1 Drawing Sheet

(51) Int. Cl.
*B65D 85/10* (2006.01)
*F23Q 1/02* (2006.01)

(56) References Cited

U.S. PATENT DOCUMENTS

| | | | | |
|---|---|---|---|---|
| 5,040,551 | A | 8/1991 | Schlatter et al. | |
| 2003/0209240 | A1 | 11/2003 | Hale et al. | |
| 2006/0032501 | A1 | 2/2006 | Hale et al. | |
| 2007/0215168 | A1* | 9/2007 | Banerjee | A24B 15/165 131/335 |
| 2009/0071477 | A1 | 3/2009 | Hale et al. | |
| 2011/0011415 | A1 | 1/2011 | Hartman | |
| 2014/0373859 | A1* | 12/2014 | Raether | A24B 15/165 131/329 |
| 2015/0289566 | A1 | 10/2015 | Carraro et al. | |
| 2015/0296882 | A1 | 10/2015 | Mironov et al. | |
| 2015/0335062 | A1* | 11/2015 | Shinkawa | A24F 47/002 131/276 |
| 2016/0143356 | A1* | 5/2016 | Poget | A24F 47/006 131/329 |
| 2016/0316816 | A1* | 11/2016 | Lavanchy | A24D 1/02 |
| 2016/0324215 | A1* | 11/2016 | Mironov | A24F 47/008 |
| 2017/0027226 | A1* | 2/2017 | Mironov | A24F 47/008 |
| 2017/0035116 | A1* | 2/2017 | Batista | A24F 47/008 |
| 2017/0055577 | A1* | 3/2017 | Batista | A24B 15/165 |
| 2017/0318859 | A1* | 11/2017 | Batista | A24D 1/08 |

FOREIGN PATENT DOCUMENTS

| | | | |
|---|---|---|---|
| GB | 956 544 | A | 4/1964 |
| WO | WO 2009/022232 | A2 | 2/2009 |
| WO | WO 2009/074870 | A2 | 6/2009 |
| WO | WO 2012/164077 | A1 | 12/2012 |
| WO | WO 2014/086998 | A1 | 6/2014 |
| WO | WO 2014/086999 | A1 | 6/2014 |

OTHER PUBLICATIONS

"Tailor-Made Solutions for the Chemical Industry," Fette Compacting, 2017, pp. 1-2.

Joan Reinbold, "What Is a Match Head Made of?" eHow, Feb. 21, 2014, pp. 1-3.

International Search Report and Written Opinion dated Feb. 15, 2016 in PCT/EP2015/077397, filed Nov. 23, 2015.

* cited by examiner

SMOKING ARTICLE COMPRISING A FRICTION IGNITABLE COMBUSTIBLE CARBONACEOUS HEAT SOURCE

TECHNICAL FIELD

The present invention relates to a smoking article comprising a friction ignitable combustible carbonaceous heat source.

DESCRIPTION OF THE RELATED ART

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible carbonaceous heat source to an aerosol-forming substrate located downstream of the combustible carbonaceous heat source. During smoking, volatile compounds are released from the aerosol-forming substrate by heat transfer from the combustible carbonaceous heat source and entrained in air drawn through the smoking article. As the released compounds cool, they condense to form an aerosol that is inhaled by the user.

For example, WO-A2-2009/022232 discloses a smoking article comprising a combustible carbonaceous heat source, an aerosol-forming substrate downstream of the combustible carbonaceous heat source, and a heat-conducting element around and in direct contact with a rear portion of the combustible carbonaceous heat source and an adjacent front portion of the aerosol-forming substrate.

The combustion temperature of a combustible carbonaceous heat source for use in a heated smoking article should not be so high as to result in combustion or thermal degradation of the aerosol forming material during use of the heated smoking article. However, the combustion temperature of the combustible carbonaceous heat source should be sufficiently high to generate enough heat to release sufficient volatile compounds from the aerosol forming material to produce an acceptable aerosol, especially during early puffs. To avoid a delay between a user igniting the combustible carbonaceous heat source and an acceptable aerosol being produced, the combustible carbonaceous heat source should rapidly reach an appropriate combustion temperature after ignition thereof.

A variety of combustible carbon-containing heat sources for use in heated smoking articles are known in the art. However, known combustible carbon-containing heat sources for heated smoking articles are often difficult to ignite.

It has been proposed in the art to include oxidizing agents and other additives in combustible carbon-containing heat sources for heated smoking articles in order to improve the ignition and combustion properties thereof. For example, EP-A1-0 627 174 discloses that oxidants such as perchlorates, chlorates, nitrates and permanganates may be included in the carbonaceous heat sources disclosed therein in an amount of between about 0.05% and 10% by weight of the heat source to either lower the ignition temperature or to otherwise aid in the combustion of the heat source.

Failure to properly ignite the combustible carbon-containing heat source of a heated smoking article may lead to an unacceptable aerosol being delivered to a user.

It would be desirable to provide a heated smoking article comprising a combustible carbon-containing heat source that can be ignited easily and rapidly by a user in a reliable and consistent manner without the use of a match, lighter or other external heat source.

SUMMARY

According to the invention there is provided a smoking article comprising: a combustible carbonaceous heat source having opposed front and rear end faces; an aerosol-forming substrate downstream of the rear end face of the combustible carbonaceous heat source; and an ignitable composition provided on at least a portion of the front end face of the combustible carbonaceous heat source; and one or more airflow pathways along which air may be drawn through the smoking article for inhalation by a user, wherein the ignitable composition is capable of being ignited by striking the front end face of the combustible carbonaceous heat source on a frictional surface and wherein the ignitable composition is isolated from the one or more airflow pathways such that, in use, air drawn along the one or more airflow pathways does not directly contact the ignitable composition.

BRIEF DESCRIPTION OF THE DRAWINGS

Embodiments will now be further described, by way of example only, with reference to the accompanying drawings in which.

DETAILED DESCRIPTION

Figure 1:
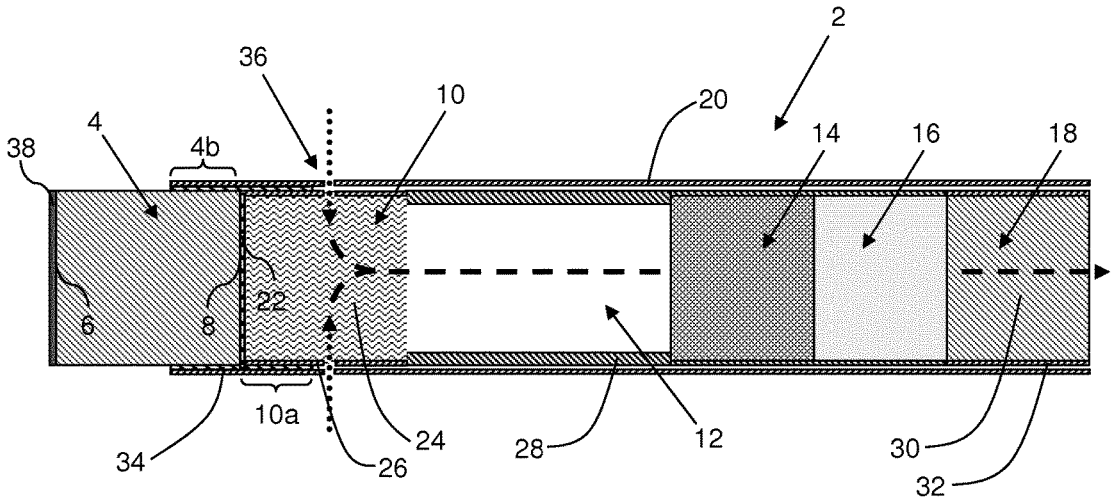
FIG. 1 shows a schematic longitudinal cross-section of a smoking article according to a first embodiment.

As used herein, the term 'carbonaceous' is used to describe combustible carbonaceous heat sources, particulate components and particulate materials comprising carbon.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be in the form of a plug or segment comprising a material capable of releasing upon heating volatile compounds, which can form an aerosol, circumscribed by a wrapper. Where an aerosol-forming substrate is in the form of such a plug or segment, the entire plug or segment including the wrapper is considered to be the aerosol-forming substrate.

As used herein, the terms 'distal', 'upstream' and 'front', and 'proximal', 'downstream' and 'rear', are used to describe the relative positions of components, or portions of components, of the smoking article. Smoking articles according to the invention comprise a proximal end through which, in use, an aerosol exits the smoking article for delivery to a user. The proximal end of the smoking article may also be referred to as the mouth end. In use, a user draws on the proximal end of the smoking article in order to inhale an aerosol generated by the smoking article.

The combustible carbonaceous heat source is located at or proximate to the distal end of the smoking article. The mouth end of the smoking article is downstream of the distal end of the smoking article. The proximal end of the smoking article may also be referred to as the downstream end of the smoking article and the distal end of the smoking article may also be referred to as upstream end of the smoking article. Components, or portions of components, of smoking articles according to the invention may be described as being upstream or downstream of one another based on their relative positions between the proximal end of the smoking article and the distal end of the smoking article.

The front end face of the combustible carbonaceous heat source is at the upstream end of the combustible carbonaceous heat source. The upstream end of the combustible carbonaceous heat source is the end of the combustible carbonaceous heat source furthest from the proximal end of the smoking article. The rear end face of the combustible carbonaceous heat source is at the downstream end of the combustible carbonaceous heat source. The downstream end of the combustible carbonaceous heat source is the end of the combustible carbonaceous heat source closest to the proximal end of the smoking article.

As used herein, the terms 'longitudinal' and 'axial' are used to describe the direction between the opposed front and rear end faces of the combustible carbonaceous heat source and the proximal end and the opposed distal end of the smoking article.

As used herein, the term 'length' is used to describe the maximum dimension in the longitudinal direction of the combustible carbonaceous heat source or smoking article. That is, the maximum dimension in the direction between the opposed front and rear end faces of the combustible carbonaceous heat source or the proximal end and the opposed distal end of the smoking article.

As used herein, the terms 'radial' and 'transverse' are used to describe the direction perpendicular to the longitudinal direction. That is, the direction perpendicular to the direction between the opposed front and rear end faces of the combustible carbonaceous heat source and the proximal end and the opposed distal end of the smoking article.

As used herein, the term 'diameter' denotes the maximum dimension in the transverse direction of the combustible carbonaceous heat source or smoking article.

An ignitable composition is provided on at least a portion of the front end face of the combustible carbonaceous heat source, which is capable of being ignited by striking the front end face of the combustible carbonaceous heat source on a frictional surface.

In use, frictional heat generated by striking the front end face of the combustible carbonaceous heat source on the frictional surface ignites the ignition composition, which in turn ignites the combustible carbonaceous heat source. The inclusion of such an ignition composition thereby advantageously allows the combustible carbonaceous heat source of smoking articles according to the invention to be ignited easily and rapidly by a user in a reliable and consistent manner without the use of a match, lighter or other external heat source.

Suitable ignitable compositions for use in the invention are known in the art for use in friction matches.

In certain embodiments, the ignitable composition may be capable of being ignited by striking the front end face of the combustible carbonaceous heat source on any frictional surface. Smoking articles according to such embodiments are referred to herein as comprising 'strike-anywhere' combustible carbonaceous heat sources.

Suitable ignitable compositions for use in 'strike-anywhere' embodiments of the invention are known in the art for use in 'strike-anywhere' matches. For example, the ignitable composition may comprise phosphorus or phosphorus sesquisulfide ($P_4S_3$), one or more oxidizing agents, such as potassium chlorate, and optionally sulfur. The ignitable compound may further comprise one or more abrasive materials, such as powdered glass or silica, one or more fillers, one or more binders, such as starch, one or more neutralizers, such as zinc oxide, one or more colorants, or any combination thereof.

In other embodiments, the ignitable composition may be capable of being ignited by striking the front end face of the combustible carbonaceous heat source on a specially adapted cooperating striking surface.

Smoking articles according to such embodiments are referred to herein as comprising 'safety' combustible carbonaceous heat sources.

Suitable ignitable compositions and striking surfaces for use in 'safety' embodiments of the invention are known in the art for use in 'safety' matches.

For example, the ignitable composition may comprise sulfur, one or more oxidizing agents, such as potassium chlorate, and optionally antimony (III) sulfide ($Sb_2S_3$) and the cooperating striking surface may comprise red phosphorus.

The ignitable compound may further comprise one or more abrasive materials, such as powdered glass or silica, one or more fillers, one or more binders, such as starch, one or more neutralisers, such as zinc oxide (ZnO) or calcium carbonate ($CaCO_3$), one or more colorants, or any combination thereof. The cooperating striking surface may further comprise, one or more abrasive materials, such as powdered glass or silica, one or more fillers, one or more binders, such as starch, one or more neutralisers, such as carbon black, one or more colourants, or any combination thereof.

According to the invention there is also provided a container of smoking articles comprising: a plurality of smoking articles according to the invention; and a cooperating striking surface, wherein the ignitable composition provided on at least a portion of the front end face of the combustible carbonaceous heat source of each of the plurality of smoking articles is capable of being ignited by striking the front end face of the combustible carbonaceous heat source on the cooperating striking surface.

The cooperating striking surface may be of any suitable shape and size and may be provided on any suitable part of the container. For example, the container may be a hinge-lid pack and the cooperating striking surface may be provided on the outer surface of one of the sides of the pack. Alternatively or in addition, the cooperating striking surface may be provided on an inner surface of the pack or on a surface of a separate element provided within the pack.

Smoking articles according to the invention comprises one or more airflow pathways along which air may be drawn through the smoking article for inhalation by a user, As used herein, the term 'airflow pathway' is used to describe a route along which air may be drawn through the smoking article for inhalation by a user.

The ignitable composition is isolated from the one or more airflow pathways such that, in use, air drawn along the one or more airflow pathways does not directly contact the ignitable composition.

As used herein, the expression 'directly contact' is used to describe contact between air passing through the one or more airflow pathways and a portion of the combustible heat source on which the ignitable composition is provided.

Isolation of the ignitable composition from the one or more airflow pathways advantageously substantially prevents or inhibits combustion and decomposition products and other materials formed during ignition of the ignitable composition from entering air drawn through the smoking articles along the one or more airflow pathways.

In preferred embodiments, the ignitable composition is in direct contact with the combustible carbonaceous heat source. In such preferred embodiments, there is no intermediate material between the ignitable composition and the combustible carbonaceous heat source. This may advantageously facilitate ignition of the combustible carbonaceous heat source by the ignitable composition.

In preferred embodiments, the ignitable composition is provided on only a portion of the combustible carbonaceous heat source. In such preferred embodiments, at least a portion of the combustible carbonaceous heat source may be exposed to oxygen from the air. This may advantageously facilitate sustained combustion of the combustible carbonaceous heat source.

In certain embodiments, the ignitable composition may be provided on at least substantially the entire front end face of the combustible carbonaceous heat source. For example, a coating or layer of the ignitable composition may be provided on the entire front end face of the combustible carbonaceous heat source.

As used herein, the term 'coating' is used to describe a layer of material that covers and is adhered to the combustible carbonaceous heat source.

In other embodiments, the ignitable composition may be provided on only a portion of the front end face of the combustible carbonaceous heat source. This may increase the surface area of the front end face of the combustible carbonaceous heat source that is exposed to oxygen from the air which may advantageously facilitate sustained combustion of the combustible carbonaceous heat source.

In some embodiments, the ignitable composition may be provided on only a central portion of the front end face of the combustible carbonaceous heat source. This may advantageously facilitate reliable and consistent ignition of the combustible carbonaceous heat source irrespective of the orientation in which the front end face of the combustible carbonaceous heat source is struck on a frictional surface. For example, a coating or layer of the ignitable composition may be provided on only a central portion of the front end face of the combustible carbonaceous heat source.

A coating of the ignitable composition may be provided on at least a portion of the front end face of the combustible carbonaceous heat source by applying a solution or suspension of the ignitable composition to the front end face of the combustible carbonaceous heat source. For example, a coating of the ignitable composition may be provided on the front end face of the combustible carbonaceous heat source by dipping the front end face of the combustible carbonaceous heat source in a solution or suspension of the ignitable composition or by brushing or spray-coating a solution or suspension of the ignitable composition onto the front end face of the combustible carbonaceous heat source.

Alternatively, a layer of the ignitable composition may be provided on at least a portion of the front end face of the combustible carbonaceous heat source by a pressing process. For example, the combustible carbonaceous heat source may be formed with the ignitable composition provided on the front end face thereof using existing rotary pressing technology known to manufacture multi-component, multi-layer products, such as washing machine and dishwasher tablets.

According to the invention there is provided a smoking article according to the invention wherein the combustible carbonaceous heat source with the ignitable composition provided on at least a portion of the front end face of the combustible carbonaceous heat source is produced by pressing.

Where the ignitable composition is provided on only a portion of the front end face of the combustible carbonaceous heat source, shape, the ignitable composition may have any suitable shape and size. For example, the ignitable composition may be in the form of a sphere or disk.

The amount and location of the ignitable composition provided on the front end face of the combustible carbonaceous heat source should be selected to achieve reliable and consistent ignition of the combustible carbonaceous heat source when the front end face of the combustible carbonaceous heat source is struck on a frictional surface.

In preferred embodiments, the ignitable composition is only provided on the front end face of the combustible carbonaceous heat source. In such preferred embodiments, the ignitable composition is not provided on any portion of the combustible carbonaceous heat source other than the front end face of the combustible carbonaceous heat source. This may increase the surface area of the combustible carbonaceous heat source that is exposed to oxygen from the air which may advantageously facilitate sustained combustion of the combustible carbonaceous heat source.

However, it will be appreciated that in other embodiments, in addition to being provided on at least a portion of the front end face of the combustible carbonaceous heat source, the ignitable composition may also be provided on a portion of the combustible carbonaceous heat source other than the front end face of the combustible carbonaceous heat source. This may increase the amount of ignitable composition provided on the combustible carbonaceous heat source which may advantageously facilitate ignition of the combustible carbonaceous heat source. For example, the ignitable composition may be provided on at least a portion of the front end face of the combustible carbonaceous heat source and an adjacent side portion of the combustible carbonaceous heat source.

Smoking articles according to the invention may further comprise a cap configured to at least partially cover the front end face of the combustible carbonaceous heat source, wherein the cap is removable to expose the front end face of the combustible carbonaceous heat source prior to use of the smoking article.

As used herein, the term 'cap' refers to a protective cover that substantially surrounds the distal end of the smoking article, including the front end face. Providing a cap that is removed prior to ignition of the smoking article advantageously protects that the ignitable composition provided on at least a portion of the front end face of the combustible carbonaceous heat source. This is particularly preferred in 'strike anywhere' embodiments of the invention.

For example, smoking articles according to the invention may comprise a removable cap attached at a line of weakness to the distal end of the smoking article, wherein the cap comprises a cylindrical plug of material circumscribed by a wrapper as described in WO-A1-2014/086998.

Smoking articles according to the invention may further comprise a non-combustible substantially air impermeable barrier between the rear end face of the combustible carbonaceous heat source and the aerosol-forming substrate.

As used herein, the term 'non-combustible' is used to describe a barrier that is substantially non-combustible at temperatures reached by the combustible carbonaceous heat source during combustion and ignition thereof.

The barrier may abut one or both of the rear end face of the combustible carbonaceous heat source and the aerosol-forming substrate. Alternatively, the barrier may be spaced apart from one or both of the rear end face of the combustible carbonaceous heat source and the aerosol-forming substrate.

As used herein, the term 'abut' is used to describe a component, or portion of a component, being in direct contact with another component, or portion of a component.

The barrier may be adhered or otherwise affixed to one or both of the rear end face of the combustible carbonaceous heat source and the aerosol-forming substrate.

In certain preferred embodiments, the barrier comprises a non-combustible substantially air impermeable barrier coating provided on the rear end face of the combustible carbonaceous heat source. In such embodiments, preferably the barrier comprises a barrier coating provided on at least substantially the entire rear end face of the combustible carbonaceous heat source. More preferably, the barrier comprises a barrier coating provided on the entire rear end face of the combustible carbonaceous heat source.

The barrier may advantageously limit the temperature to which the aerosol-forming substrate is exposed during ignition and combustion of the combustible carbonaceous heat source, and so help to avoid or reduce thermal degradation or combustion of the aerosol-forming substrate during use of the smoking article. This is particularly advantageous where the combustible carbonaceous heat source comprises one or more additives to aid ignition of the combustible carbonaceous heat source as described further below.

Inclusion of a non-combustible substantially air impermeable barrier between the rear end face of the combustible carbonaceous heat source and the aerosol-forming substrate may also advantageously substantially prevent or inhibit migration of components of the aerosol-forming substrate of smoking articles according to the invention to the combustible carbonaceous heat source during storage of the smoking articles.

Alternatively or in addition, inclusion of a non-combustible substantially air impermeable barrier between the rear end face of the combustible carbonaceous heat source and the aerosol-forming substrate may advantageously substantially prevent or inhibit migration of components of the aerosol-forming substrate of smoking articles according to the invention to the combustible carbonaceous heat source during use of the smoking articles.

Inclusion of a non-combustible substantially air impermeable barrier between the rear end face of the combustible carbonaceous heat source and the aerosol-forming substrate may be particularly advantageous where the aerosol-forming substrate comprises at least one aerosol-former. In such embodiments, inclusion of a non-combustible substantially air impermeable barrier between the rear end face of the combustible carbonaceous heat source and the aerosol-forming substrate may advantageously prevent or inhibit migration of the at least one aerosol-former from the aerosol-forming substrate to the combustible carbonaceous heat source during storage and use of the smoking article. Decomposition of the at least one aerosol-former during use of the smoking articles may thus be advantageously substantially avoided or reduced.

Depending upon the desired characteristics and performance of the smoking article, the barrier may have a low thermal conductivity or a high thermal conductivity. In certain embodiments, the barrier may be formed from material having a bulk thermal conductivity of between about 0.1 W per meter Kelvin (W/(m·K)) and about 200 W per meter Kelvin (W/(m·K)), at 23° C. and a relative humidity of 50% as measured using the modified transient plane source (MTPS) method.

The thickness of the barrier may be appropriately adjusted to achieve good smoking performance. In certain embodiments, the barrier may have a thickness of between about 10 microns and about 500 microns.

The barrier may be formed from one or more suitable materials that are substantially thermally stable and non-combustible at temperatures achieved by the combustible carbonaceous heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the barrier may be formed include clays and glasses. More preferred materials from which the barrier may be formed include copper, aluminium, stainless steel, alloys, alumina ($Al_2O_3$), resins, and mineral glues.

In certain preferred embodiments, the barrier comprises a clay coating comprising a 50/50 mixture of bentonite and kaolinite provided on the rear end face of the combustible carbonaceous heat source. In other preferred embodiments, the barrier comprises a glass coating, more preferably a sintered glass coating, provided on the rear end face of the combustible carbonaceous heat source.

In certain particularly preferred embodiments, the barrier comprises an aluminium coating provided on the rear end face of the combustible carbonaceous heat source.

Preferably, the barrier has a thickness of at least about 10 microns.

Due to the slight permeability of clays to air, in embodiments where the barrier comprises a clay coating provided on the rear end face of the combustible carbonaceous heat source, the clay coating more preferably has a thickness of at least about 50 microns, and most preferably of between about 50 microns and about 350 microns.

In embodiments where the barrier is formed from one or more materials that are more impervious to air, such as aluminium, the barrier may be thinner, and generally will preferably have a thickness of less than about 100 microns, and more preferably of about 20 microns.

In embodiments where the barrier comprises a glass coating provided on the rear end face of the combustible carbonaceous heat source, the glass coating preferably has a thickness of less than about 200 microns.

The thickness of the barrier may be measured using a microscope, a scanning electron microscope (SEM) or any other suitable measurement methods known in the art.

Where the barrier comprises a barrier coating provided on the rear end face of the combustible carbonaceous heat source, the barrier coating may be applied to cover and adhere to the rear end face of the combustible carbonaceous heat source by any suitable methods known in the art including, but not limited to, spray-coating, vapour deposition, dipping, material transfer (for example, brushing or gluing), electrostatic deposition or any combination thereof.

For example, the barrier coating may be made by preforming a barrier in the approximate size and shape of the rear end face of the combustible carbonaceous heat source, and applying it to the rear end face of the combustible carbonaceous heat source to cover and adhere to at least substantially the entire rear end face of the combustible carbonaceous heat source. Alternatively, the barrier coating may be cut or otherwise machined after it is applied to the rear end face of the combustible carbonaceous heat source. In one preferred embodiment, aluminium foil is applied to the rear end face of the combustible carbonaceous heat source by gluing or pressing it to the combustible carbonaceous heat source, and is cut or otherwise machined so that the aluminium foil covers and adheres to at least substantially the entire rear end face of the combustible carbonaceous heat source, preferably to the entire rear end face of the combustible carbonaceous heat source.

In another preferred embodiment, the barrier coating is formed by applying a solution or suspension of one or more suitable coating materials to the rear end face of the combustible carbonaceous heat source. For example, the barrier coating may be applied to the rear end face of the combustible carbonaceous heat source by dipping the rear end face of the combustible carbonaceous heat source in a solution or suspension of one or more suitable coating materials or by brushing or spray-coating a solution or suspension or electrostatically depositing a powder or powder mixture of one or more suitable coating materials onto the rear end face of the combustible carbonaceous heat source. Where the barrier coating is applied to the rear end face of the combustible carbonaceous heat source by electrostatically depositing a powder or powder mixture of one or more suitable coating materials onto the rear end face of the combustible carbonaceous heat source, the rear end face of the combustible carbonaceous heat source is preferably pre-treated with water glass before electrostatic deposition. In certain preferred embodiments, the barrier coating is applied by spray-coating.

The barrier coating may be formed through a single application of a solution or suspension of one or more suitable coating materials to the rear end face of the combustible carbonaceous heat source. Alternatively, the barrier coating may be formed through multiple applications of a solution or suspension of one or more suitable coating materials to the rear end face of the combustible carbonaceous heat source. For example, the barrier coating may be formed through one, two, three, four, five, six, seven or eight successive applications of a solution or suspension of one or more suitable coating materials to the rear end face of the combustible carbonaceous heat source. In certain preferred embodiments, the barrier coating is formed through between one and ten applications of a solution or suspension of one or more suitable coating materials to the rear end face of the combustible carbonaceous heat source.

After application of the solution or suspension of one or more coating materials to the rear end face thereof, the combustible carbonaceous heat source may be dried to form the barrier coating. Where the barrier coating is formed through multiple applications of a solution or suspension of one or more suitable coating materials to the rear end face thereof, the combustible carbonaceous heat source may need to be dried between successive applications of the solution or suspension.

Alternatively or in addition to drying, after application of a solution or suspension of one or more coating materials to the rear end face of the combustible carbonaceous heat source, the coating material on the combustible carbonaceous heat source may be sintered in order to form the barrier coating. Sintering of the barrier coating is particularly preferred where the barrier coating is a glass or ceramic coating. In certain preferred embodiments, the barrier coating is sintered at a temperature of between about 500° C. and about 900° C., and more preferably at about 700° C.

Smoking articles according to the invention may comprise a non-blind combustible carbonaceous heat source. As used herein, the term 'non-blind' is used to describe a combustible carbonaceous heat source including at least one airflow channel extending from the front end face to the rear end face of the combustible carbonaceous heat source.

As used herein, the term 'airflow channel' is used to describe a channel extending along the length of a combustible carbonaceous heat source through which air may be drawn for inhalation by a user.

According to the invention there is provided a smoking article according to the invention wherein the combustible carbonaceous heat source comprises one or more airflow channels extending from the front end face to the rear end face of the combustible carbonaceous heat source.

Where smoking articles according to the invention comprise a non-blind combustible carbonaceous heat source including at least one airflow channel extending from the front end face to the rear end face of the combustible carbonaceous heat source, the at least one airflow channel forms part of the one or more airflow pathways along which air may be drawn through the smoking article for inhalation by a user.

In smoking articles according to the invention comprising a non-blind combustible carbonaceous heat source heating of the aerosol-forming substrate occurs by conduction and forced convection.

The one or more airflow channels may comprise one or more enclosed airflow channels.

As used herein, the term 'enclosed' is used to describe airflow channels that extend through the interior of the non-blind combustible carbonaceous heat source and are surrounded by the non-blind combustible carbonaceous heat source.

Alternatively or in addition, the one or more airflow channels may comprise one or more non-enclosed airflow channels. For example, the one or more airflow channels may comprise one or more grooves or other non-enclosed airflow channels that extend along the exterior of the non-blind combustible carbonaceous heat source.

The one or more airflow channels may comprise one or more enclosed airflow channels or one or more non-enclosed airflow channels or a combination thereof.

In certain embodiments, smoking articles according to the invention comprise one, two or three airflow channels extending from the front end face to the rear end face of the non-blind combustible carbonaceous heat source.

In certain preferred embodiments, smoking articles according to the invention comprise a single airflow channel extending from the front end face to the rear end face of the non-blind combustible carbonaceous heat source.

In certain particularly preferred embodiments, smoking articles according to the invention comprise comprises a single substantially central or axial airflow channel extending from the front end face to the rear end face of the non-blind combustible carbonaceous heat source.

In such embodiments, the diameter of the single airflow channel is preferably between about 1.5 mm and about 3 mm.

It will be appreciated that in addition to one or more airflow channels through which air may be drawn for inhalation by a user, smoking articles according to the invention may comprise non-blind combustible carbonaceous heat sources comprising one or more closed or blocked passageways through which air may not be drawn for inhalation by a user.

For example, smoking articles according to the invention may comprise non-blind combustible carbonaceous heat sources comprising one or more airflow channels extending from the front end face to the rear end face of the combustible carbonaceous heat source and one or more closed passageways that extend from the front end face of the non-blind combustible carbonaceous heat source only part way along the length combustible carbonaceous heat source.

The inclusion of one or more closed air passageways increases the surface area of the non-blind combustible carbonaceous heat source that is exposed to oxygen from the air and may advantageously facilitate ignition and sustained combustion of the non-blind combustible carbonaceous heat source.

Where smoking articles according to the invention comprise a non-blind combustible carbonaceous heat source and a non-combustible, substantially air impermeable barrier between the rear end face of the combustible carbonaceous heat source and the aerosol-forming substrate, the barrier should allow air entering the smoking article through the one or more airflow channels to be drawn downstream through the smoking article.

Alternatively or in addition to a non-combustible, substantially air impermeable barrier between the rear end face of the combustible carbonaceous heat source and the aerosol-forming substrate, smoking articles according to the invention comprising a non-blind combustible carbonaceous heat source may comprise a non-combustible substantially air impermeable barrier between the non-blind combustible carbonaceous heat source and the one or more airflow channels.

According to the invention there is provided a smoking article according to the invention wherein the combustible carbonaceous heat source comprises one or more airflow channels extending from the front end face to the rear end face of the combustible carbonaceous heat source, the smoking article further comprising a non-combustible substantially air impermeable barrier between the combustible heat source and the one or more airflow channels.

The barrier may advantageously substantially prevent or inhibit combustion and decomposition products formed during ignition and combustion of the ignitable composition and non-blind combustible carbonaceous heat source from entering air drawn into smoking articles according to the invention through the one or more airflow channels as the drawn air passes through the one or more airflow channels. This is particularly advantageous where the non-blind combustible carbonaceous heat source comprises one or more additives to aid ignition or combustion of the non-blind combustible carbonaceous heat source.

Inclusion of a non-combustible substantially air impermeable barrier between the non-blind combustible carbonaceous heat source and the one or more airflow channels may also advantageously substantially prevent or inhibit activation of combustion of the non-blind combustible carbonaceous heat source during puffing by a user. This may substantially prevent or inhibit spikes in the temperature of the aerosol-forming substrate during puffing by a user.

By preventing or inhibiting activation of combustion of the non-blind combustible carbonaceous heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The barrier between the non-blind combustible carbonaceous heat source and the one or more airflow channels may be adhered or otherwise affixed to the non-blind combustible carbonaceous heat source.

In certain preferred embodiments, the barrier comprises a non-combustible substantially air impermeable barrier coating provided on an inner surface of the one or more airflow channels. In such embodiments, preferably the barrier comprises a barrier coating provided on at least substantially the entire inner surface of the one or more airflow channels. More preferably, the barrier comprises a barrier coating provided on the entire inner surface of the one or more airflow channels.

In other embodiments, the barrier coating may be provided by insertion of a liner into the one or more airflow channels. For example, where the one or more airflow channels comprise one or more enclosed airflow channels that extend through the interior of the non-blind combustible carbonaceous heat source, a non-combustible substantially air impermeable hollow tube may be inserted into each of the one or more airflow channels.

Depending upon the desired characteristics and performance of the smoking article, the barrier may have a low thermal conductivity or a high thermal conductivity. Preferably, the barrier has a low thermal conductivity.

The thickness of the barrier may be appropriately adjusted to achieve good smoking performance. In certain embodiments, the barrier may have a thickness of between about 30 microns and about 200 microns. In certain preferred embodiments, the barrier has a thickness of between about 30 microns and about 100 microns.

The barrier may be formed from one or more suitable materials that are substantially thermally stable and non-combustible at temperatures achieved by the non-blind combustible carbonaceous heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the barrier may be formed include clays, glasses, aluminium, iron oxide and combinations thereof. If desired, catalytic ingredients, such as ingredients that promote the oxidation of carbon monoxide to carbon dioxide, may be incorporated in the barrier. Suitable catalytic ingredients include, but are not limited to, for example, platinum, palladium, transition metals and their oxides.

Where the barrier comprises a barrier coating provided on an inner surface of the one or more airflow channels, the barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the barrier coating. In certain preferred embodiments, the barrier coating is applied to the inner surface of the one or more airflow channels by the process described in WO-A2-2009/074870 as the combustible carbonaceous heat source is extruded.

Where smoking articles according to the invention comprise a non-blind combustible carbonaceous heat source, the ignitable composition may not be provided on the rear end face of the non-blind combustible carbonaceous heat source and the inner surface of the at least one air flow channel extending from the front end face to the rear end face of the non-blind combustible carbonaceous heat source such that, in use, air drawn along the one or more airflow pathways does not directly contact the ignitable composition.

Alternatively or in addition, where smoking articles according to the invention comprise a non-blind combustible carbonaceous heat source and one or both of:

(i) a non-combustible substantially air impermeable barrier between the rear end face of the non-blind combustible carbonaceous heat source and the aerosol-forming substrate; and (ii) a non-combustible substantially air impermeable barrier between the non-blind combustible carbonaceous heat source and the one or more airflow channels, (i) the non-combustible substantially air impermeable barrier between the rear end face of the non-blind combustible carbonaceous heat source and the aerosol-forming substrate and (ii) the non-combustible substantially air impermeable barrier between the non-blind combustible carbonaceous heat source and the one or more airflow channels may isolate the ignitable composition from the one or more airflow pathways such that, in use, air drawn along the one or more airflow pathways does not directly contact the ignitable composition.

For example, in certain embodiments where smoking articles according to the invention comprise a non-blind combustible carbonaceous heat source and:

(i) a non-combustible substantially air impermeable barrier between the rear end face of the non-blind combustible carbonaceous heat source and the aerosol-forming substrate, the ignitable composition may not be provided on the inner surface of the at least one air flow channel extending from the front end face to the rear end face of the non-blind combustible carbonaceous heat source, and (i) the non-combustible substantially air impermeable barrier between the non-blind combustible carbonaceous heat source and the aerosol-forming substrate may isolate the ignitable composition from the one or more airflow pathways, such that, in use, air drawn along the one or more airflow pathways does not directly contact the ignitable composition.

In other embodiments where smoking articles according to the invention comprise a non-blind combustible carbonaceous heat source and:

(ii) a non-combustible substantially air impermeable barrier between the non-blind combustible carbonaceous heat source and the one or more airflow channels, the ignitable composition may not be provided on the rear end face of the non-blind combustible carbonaceous heat source, and (ii) the non-combustible substantially air impermeable barrier between the non-blind combustible carbonaceous heat source and the one or more airflow channels may isolate the ignitable composition from the one or more airflow pathways, such that, in use, air drawn along the one or more airflow pathways does not directly contact the ignitable composition.

Preferably, smoking articles according to the invention comprise a blind combustible carbonaceous heat source. As used herein, the term 'blind' is used to describe a combustible carbonaceous heat source that does not include any airflow channels extending from the front end face to the rear end face of the combustible carbonaceous heat source. As used herein, the term 'blind' is also used to describe a combustible carbonaceous heat source including one or more airflow channels extending from the front end face of the combustible carbonaceous heat source to the rear end face of the combustible carbonaceous heat source, wherein a non-combustible substantially air impermeable barrier between the rear end face of the combustible carbonaceous heat source and the aerosol-forming substrate barrier prevents air from being drawn along the length of the combustible carbonaceous heat source through the one or more airflow channels.

Smoking articles according to the invention comprising blind combustible heat sources comprise one or more air inlets downstream of the rear end face of the combustible heat source for drawing air into the one or more airflow pathways. Smoking articles according to the invention comprising non-blind combustible heat sources may also comprise one or more air inlets downstream of the rear end face of the combustible heat source for drawing air into the one or more airflow pathways.

In certain preferred embodiments, smoking articles according to the invention comprising blind combustible heat sources comprise one or more air inlets located proximate to the downstream end of the aerosol-forming substrate.

In use, air drawn along the one or more airflow pathways of smoking articles according to the invention comprising a blind combustible carbonaceous heat source for inhalation by a user does not pass through any airflow channels along the blind combustible carbonaceous heat source. The lack of any airflow channels through the blind combustible carbonaceous heat source advantageously substantially prevents or inhibits activation of combustion of the blind combustible carbonaceous heat source during puffing by a user. This substantially prevents or inhibits spikes in the temperature of the aerosol-forming substrate during puffing by a user.

By preventing or inhibiting activation of combustion of the blind combustible carbonaceous heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The inclusion of a blind combustible carbonaceous heat source may also advantageously substantially prevent or inhibit combustion and decomposition products and other materials formed during ignition and combustion of the blind combustible carbonaceous heat source from entering air drawn through smoking articles according to the invention during use thereof. This is particularly advantageous where the blind combustible carbonaceous heat source comprises one or more additives to aid ignition or combustion of the blind combustible carbonaceous heat source.

In smoking articles according to the invention comprising a blind combustible carbonaceous heat source, heat transfer from the blind combustible carbonaceous heat source to the aerosol-forming substrate occurs primarily by conduction and heating of the aerosol-forming substrate by forced convection is minimised or reduced. This may advantageously help to minimise or reduce the impact of a user's puffing regime on the composition of the mainstream aerosol of smoking articles according to the invention.

In smoking articles according to the invention comprising a blind combustible carbonaceous heat source, it is particularly important to optimise the conductive heat transfer between the combustible carbonaceous heat source and the aerosol-forming substrate. As described further below, the inclusion of one or more heat-conducting elements around at least a rear portion of the combustible carbonaceous heat source and at least a front portion of the aerosol-forming substrate is particularly preferred in smoking articles according to the invention including blind heat sources, where there is little if any heating of the aerosol-forming substrate by forced convection.

It will be appreciated that smoking articles according to the invention may comprise blind combustible carbonaceous heat sources comprising one or more closed or blocked passageways through which air may not be drawn for inhalation by a user.

For example, smoking articles according to the invention may comprise blind combustible carbonaceous heat sources comprising one or more closed passageways that extend from the front end face at the upstream end of the blind combustible carbonaceous heat source only part way along the length of the blind combustible carbonaceous heat source.

The inclusion of one or more closed air passageways increases the surface area of the blind combustible carbonaceous heat source that is exposed to oxygen from the air and may advantageously facilitate ignition and sustained combustion of the blind combustible carbonaceous heat source.

Where smoking articles according to the invention comprise a blind combustible carbonaceous heat source, the ignitable composition may not be provided on the rear end face of the combustible carbonaceous heat source such that, in use, air drawn along the one or more airflow pathways does not directly contact the ignitable composition.

Alternatively or in addition, where smoking articles according to the invention comprise a blind combustible carbonaceous heat source and a non-combustible substantially air impermeable barrier between the rear end face of the combustible carbonaceous heat source and the aerosol-forming substrate, the non-combustible substantially air impermeable barrier between the rear end face of the combustible carbonaceous heat source and the aerosol-forming substrate may isolate the ignitable composition from the one or more airflow pathways such that, in use, air drawn along the one or more airflow pathways does not directly contact the ignitable composition.

Preferably, the combustible carbonaceous heat source has a carbon content of at least about 35 percent, more preferably of at least about 40 percent, most preferably of at least about 45 percent by dry weight of the combustible carbonaceous heat source.

In some embodiments, the combustible carbonaceous heat source may be a combustible carbon-based heat source. As used herein, the term 'carbon-based' is used to describe a combustible carbonaceous heat source comprised primarily of carbon, that is a combustible carbonaceous heat source having a carbon content of at least about 50 percent. For example, the combustible carbonaceous heat source may have a carbon content of at least about 60 percent, or at least about 70 percent, or at least about 80 percent by dry weight of the combustible carbonaceous heat source.

The combustible carbonaceous heat source may be formed from one or more suitable carbon-containing materials.

One or more binders may be combined with the one or more carbon-containing materials. In such embodiments, the combustible carbonaceous heat source may comprise one or more organic binders, one or more inorganic binders or a combination of one or more organic binders and one or more inorganic binders.

Suitable organic binders include but are not limited to: gums, such as, for example, guar gum; modified celluloses and cellulose derivatives such as, for example, methyl cellulose, carboxymethyl cellulose, hydroxypropyl cellulose and hydroxypropyl methylcellulose; flours; starches; sugars; vegetable oils; and combinations thereof.

Suitable inorganic binders include but are not limited to: clays such as, for example, bentonite and kaolinite; alumino-silicate derivatives such as, for example, cement; alkali activated alumino-silicates; alkali silicates such as, for example, sodium silicates and potassium silicates; limestone derivatives such as, for example, lime and hydrated lime; alkaline earth compounds and derivatives such as, for example, magnesia cement, magnesium sulfate, calcium sulfate, calcium phosphate and dicalcium phosphate; aluminium compounds and derivatives such as, for example, aluminium sulfate and combinations thereof.

Instead of, or in addition to one or more binders, the combustible carbonaceous heat source may comprise one or more additives in order to improve the properties of the combustible carbonaceous heat source. Suitable additives include, but are not limited to, additives to promote consolidation of the combustible carbonaceous heat source (for example, sintering aids), additives to promote ignition of the combustible carbonaceous heat source (for example, oxidisers such as perchlorates, chlorates, nitrates, peroxides, permanganates, zirconium and combinations thereof), additives to promote combustion of the combustible carbonaceous heat source (for example, potassium and potassium salts, such as potassium citrate) and additives to promote decomposition of one or more gases produced by combustion of the combustible carbonaceous heat source (for example catalysts, such as CuO, $Fe_2O_3$ and $Al_2O_3$).

Preferably, the combustible carbonaceous heat source comprises at least one ignition aid. In certain preferred embodiments, the combustible carbonaceous heat source comprises at least one ignition aid as described in WO-A1-2012/164077.

As used herein, the term 'ignition aid' is used to denote a material that releases one or both of energy and oxygen during ignition of the combustible carbonaceous heat source, where the rate of release of one or both of energy and oxygen by the material is not ambient oxygen diffusion limited. In other words, the rate of release of one or both of energy and oxygen by the material during ignition of the combustible carbonaceous heat source is largely independent of the rate at which ambient oxygen can reach the material. As used herein, the term 'ignition aid' is also used to denote an elemental metal that releases energy during ignition of the combustible carbonaceous heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of a combustible carbonaceous heat source, such alkali metal burn salts do not release enough energy during ignition of a combustible carbonaceous heat source to produce an acceptable aerosol during early puffs of a smoking article comprising the combustible carbonaceous heat source.

Examples of suitable ignition aids include, but are not limited to: energetic materials that react exothermically with oxygen upon ignition of the combustible carbonaceous heat source such as, for example, aluminium, iron, magnesium and zirconium; thermites or thermite composites comprising a reducing agent such as, for example, a metal, and an oxidizing agent such as, for example, a metal oxide, that react with one another to release energy upon ignition of the combustible carbonaceous heat source; materials that undergo exothermic reactions upon ignition of the combustible carbonaceous heat source such as, for example, intermetallic and bi-metallic materials, metal carbides and metal hydrides; and oxidizing agents that decompose to release oxygen upon ignition of the combustible carbonaceous heat source.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulfates; sulfites; other sulfoxides; phosphates; phospinates; phosphites; and phosphanites.

The combustible carbonaceous heat source is preferably formed by mixing one or more carbon-containing materials with one or more binders and any other additives, where included, and forming the mixture into a desired shape. The mixture of one or more carbon containing materials, one or more binders and optional other additives may be preformed into a desired shape using any suitable known ceramic forming methods such as, for example, slip casting, extrusion, injection moulding and die compaction or pressing.

Preferably, the combustible carbonaceous heat source is formed by a pressing process or an extrusion process. Most preferably, the combustible carbonaceous heat source is formed by a pressing process.

Preferably, the mixture of one or more carbon-containing materials, one or more binders and optional other additives is formed into a cylindrical rod. However, it will be appreciated that the mixture of one or more carbon-containing materials, one or more binders and optional other additives may be formed into other desired shapes.

After formation, the cylindrical rod or other desired shape is preferably dried to reduce its moisture content.

The combustible carbonaceous heat source may comprise a single layer. Alternatively, the combustible carbonaceous heat source may be multilayer combustible carbonaceous heat source comprising a plurality of layers.

Preferably, the combustible carbonaceous heat source has an apparent density of between about 0.8 g/cm$^3$ and about 1.1 g/cm$^3$.

Preferably, the combustible carbonaceous heat source has a mass of between about 300 mg and about 500 mg, more preferably of between about 400 mg and about 450 mg.

Preferably, the combustible carbonaceous heat source has a length of between about 7 mm and about 17 mm, more preferably of between about 7 mm and about 15 mm, most preferably of between about 7 mm and about 13 mm.

Preferably, the combustible carbonaceous heat source has a diameter of between about 5 mm and about 9 mm, more preferably of between about 7 mm and about 8 mm.

Preferably, the combustible carbonaceous heat source is of substantially uniform diameter. However, the combustible carbonaceous heat source may alternatively be tapered such that the diameter of one of the front end face and the rear end face of the combustible carbonaceous heat source is greater than the diameter of the other of the front end face and the rear end face thereof. For example, combustible carbonaceous heat sources according to the invention may be tapered such that the diameter of the rear end face of the combustible carbonaceous heat source is greater that the diameter of the front end face of the combustible carbonaceous heat source.

Preferably, the combustible carbonaceous heat source is substantially cylindrical. The combustible carbonaceous heat source may be a cylindrical combustible carbonaceous heat source of substantially circular cross-section or of substantially elliptical cross-section.

In particularly preferred embodiments, the combustible carbonaceous heat source is a substantially cylindrical combustible carbonaceous heat source of substantially circular cross-section.

Preferably, the aerosol-forming substrate comprises at least one aerosol-former and a material capable of releasing volatile compounds in response to heating. The aerosol-forming substrate may comprise other additives and ingredients including, but not limited to, humectants, flavourants, binders and mixtures thereof.

Preferably, the aerosol-forming substrate comprises nicotine. More preferably, the aerosol-forming substrate comprises tobacco.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon.

Preferably, the material capable of emitting volatile compounds in response to heating is a charge of tobacco-based material, most preferably a charge of homogenised tobacco-based material.

The aerosol-forming substrate may be in the form of a plug or segment comprising a material capable of emitting volatile compounds in response to heating circumscribed by a paper or other wrapper. As stated above, where an aerosol-forming substrate is in the form of such a plug or segment, the entire plug or segment including any wrapper is considered to be the aerosol-forming substrate.

The aerosol-forming substrate preferably has a length of between about 5 mm and about 20 mm. In certain embodiments, the aerosol-forming substrate may have a length of between about 6 mm and about 15 mm or a length of between about 7 mm and about 12 mm.

In preferred embodiments, the aerosol-forming substrate comprises a plug of tobacco-based material wrapped in a plug wrap. In particularly preferred embodiments, the aerosol-forming substrate comprises a plug of homogenised tobacco-based material wrapped in a plug wrap.

Smoking articles according to the invention may comprise one or more first air inlets around the periphery of the aerosol-forming substrate.

In such embodiments, in use, cool air is drawn into the aerosol-forming substrate of the smoking article through the first air inlets. The air drawn into the aerosol-forming substrate through the first air inlets passes downstream through the smoking article from the aerosol-forming substrate and exits the smoking article through the proximal end thereof.

In such embodiments, during puffing by a user the cool air drawn through the one or more first air inlets around the periphery of the aerosol-forming substrate advantageously reduces the temperature of the aerosol-forming substrate. This advantageously substantially prevents or inhibits spikes in the temperature of the aerosol-forming substrate during puffing by a user.

As used herein, the term 'cool air' is used to describe ambient air that is not significantly heated by the combustible carbonaceous heat source upon puffing by a user.

By preventing or inhibiting spikes in the temperature of the aerosol-forming substrate, the inclusion of one or more first air inlets around the periphery of the aerosol-forming substrate, advantageously helps to avoid or reduce combustion or pyrolysis of the aerosol-forming substrate under intense puffing regimes. In addition, the inclusion of one or more first air inlets around the periphery of the aerosol-forming substrate advantageously helps to minimise or reduce the impact of a user's puffing regime on the composition of the mainstream aerosol of smoking articles according to the invention.

The number, shape, size and location of the first air inlets may be appropriately adjusted to achieve a good smoking performance.

In certain preferred embodiments, the one or more first air inlets are located proximate to the downstream end of the aerosol-forming substrate.

In certain embodiments, the aerosol-forming substrate may abut the rear end face of the combustible carbonaceous heat source or a non-combustible substantially air impermeable barrier coating provided on the rear end face of the combustible carbonaceous heat source.

In other embodiments, the aerosol-forming substrate may be spaced apart from the rear end face of the combustible carbonaceous heat source or a non-combustible substantially air impermeable barrier coating provided on the rear end face of the combustible carbonaceous heat source. That is, there may be a space or gap between the aerosol-forming substrate and the rear end face of the combustible carbonaceous heat source.

In such embodiments, alternatively or in addition to one or more first air inlets around the periphery of the aerosol-forming substrate, smoking articles according to the invention may comprise one or more second air inlets between the rear end face of the combustible carbonaceous heat source and the aerosol-forming substrate. In use, cool air is drawn into the space between the rear end face of the combustible carbonaceous heat source and the aerosol-forming substrate through the second air inlets. The air drawn into the space between the rear end face of the combustible carbonaceous heat source and the aerosol-forming substrate through the second air inlets passes downstream through the aerosol-forming substrate to the mouthpiece and exits the smoking article through the proximal end thereof.

During puffing by a user, cool air drawn through the one or more second inlets between the rear end face of the combustible carbonaceous heat source and the aerosol-forming substrate advantageously reduces the temperature of the aerosol-forming substrate of smoking articles according to the invention. This advantageously substantially prevents or inhibits spikes in the temperature of the aerosol-forming substrate of smoking articles according to the invention during puffing by a Alternatively or in addition to one or both of one or more first air inlets around the periphery of the aerosol-forming substrate and one or more second inlets between the rear end face of the combustible carbonaceous heat source and the aerosol-forming substrate, smoking articles according to the invention may further comprise one or more third air inlets downstream of the aerosol-forming substrate.

Preferably, smoking articles according to the invention further comprise one or more heat-conducting elements around at least a rear portion of the combustible carbonaceous heat source and at least a front portion of the aerosol-forming substrate.

According to the invention there is provided a smoking article according to the invention further comprising a heat-conducting element around a rear portion of the combustible carbonaceous heat source and at least a front portion of the aerosol-forming substrate.

Smoking articles according to the invention may comprise a heat-conducting element around and in direct contact with both at least a rear portion of the combustible carbonaceous heat source and at least a front portion of the aerosol-forming substrate. In such embodiments, the heat-conducting element provides a thermal link between the combustible carbonaceous heat source and the aerosol-forming substrate of smoking articles according to the invention and advantageously helps to facilitate adequate heat transfer from the combustible carbonaceous heat source to the aerosol-forming substrate to provide an acceptable aerosol.

Alternatively or in addition, smoking articles according to the invention may comprise a heat-conducting element spaced apart from one or both of the combustible carbonaceous heat source and the aerosol-forming substrate, such that there is no direct contact between the heat-conducting element and one or both of the combustible carbonaceous heat source and the aerosol-forming substrate.

The one or more heat-conducting elements are preferably non-combustible. In certain embodiments, the one or more heat conducting elements may be oxygen restricting. In other words, the one or more heat-conducting elements may inhibit or resist the passage of oxygen through the heat-conducting element.

Suitable heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers.

Smoking articles according to the invention preferably comprise a mouthpiece located at the proximal end thereof.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Smoking articles according to the invention preferably further comprise a transfer element or spacer element between the aerosol-forming substrate and the mouthpiece.

The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible carbonaceous heat source to the aerosol-forming substrate. The inclusion of a transfer element also advantageously allows the overall length of the smoking article to be adjusted to a desired value, for example to a length similar to that of a conventional cigarette, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the smoking article, and the presence and length of other components within the smoking article.

Preferably, the transfer element comprises at least one open-ended tubular hollow body. In such embodiments, in use, air drawn into the smoking article passes through the at least one open-ended tubular hollow body as it passes downstream through the smoking article from the aerosol-forming substrate to the mouthpiece.

The transfer element may comprise at least one open-ended tubular hollow body formed from one or more suitable materials that are substantially thermally stable at the temperature of the aerosol generated by the transfer of heat from the combustible carbonaceous heat source to the aerosol-forming substrate. Suitable materials are known in the art and include, but are not limited to, paper, cardboard, plastics, such a cellulose acetate, ceramics and combinations thereof.

Alternatively or in addition, smoking articles according to the invention may comprise an aerosol-cooling element or heat exchanger between the aerosol-forming substrate and the mouthpiece. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Smoking articles according to the invention may comprise one or more aerosol modifying agents downstream of the aerosol-forming substrate. For example, one or more of the mouthpiece, transfer element and aerosol-cooling element of smoking articles according to the invention may comprise one or more aerosol modifying agents.

As used herein, the term 'aerosol-modifying agent' is used to describe any agent that, in use, modifies one or more features or properties of an aerosol generated by the aerosol-forming substrate of the smoking article.

According to the invention there is provided a smoking article according to the invention further comprising one or more aerosol modifying agents downstream of the aerosol-forming substrate.

Suitable aerosol-modifying agents include, but are not limited to: flavourants; and chemesthetic agents.

As used herein, the term 'chemesthetic agent' is used to describe any agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

Smoking articles according to the invention may comprise one or more aerosol modifying agents that are both a flavourant and a chemesthetic agent downstream of the aerosol-forming substrate. For example, one or more of the mouthpiece, transfer element and aerosol-cooling element of smoking articles according to the invention may comprise menthol or another flavourant that provides a cooling chemesthetic effect.

Preferably, smoking articles according to the invention comprise an outer wrapper that circumscribes the aerosol-forming substrate and at least a rear portion of the combustible carbonaceous heat source. The outer wrapper should grip the combustible carbonaceous heat source and the aerosol-forming substrate of the smoking article when the smoking article is assembled.

More preferably, smoking articles according to the invention comprise an outer wrapper that circumscribes the aerosol-forming substrate, at least a rear portion of the combustible carbonaceous heat source and any other components of the smoking article downstream of the aerosol-forming substrate.

Smoking articles according to the invention may comprise outer wrappers formed from any suitable material or combination of materials. Suitable materials are well known in the art and include, but are not limited to, cigarette paper.

Smoking articles according to the invention may be assembled using known methods and machinery.

For the avoidance of doubt, features described above in relation to one aspect of the invention may also be applicable to other aspects of the invention. In particular, features described above in relation to smoking articles according to the invention may also relate, where appropriate, to containers of smoking articles according to the invention, and vice versa.

All scientific and technical terms used herein have meanings commonly used in the art unless otherwise specified. The definitions provided herein are to facilitate understanding of certain terms used frequently herein.

The terms 'preferred' and 'preferably' refer to embodiments of the invention that may afford certain benefits, under certain circumstances. Particularly preferred are smoking articles, combustible carbonaceous heat source assemblies and methods of manufacturing combustible carbonaceous heat source assemblies according to the invention comprising combinations of preferred features. However, it will be appreciated that other embodiments may also be preferred, under the same or other circumstances. Furthermore, the recitation of one or more preferred embodiments does not imply that other embodiments are not useful, and is not intended to exclude other embodiments from the scope of the claims.

The smoking article 2 according to the first embodiment of the invention shown in FIG. 1 comprises a combustible carbonaceous heat source 4 having a front end face 6 and an opposed rear end face 8, an aerosol-forming substrate 10, a transfer element 12, an aerosol-cooling element 14, a spacer element 16 and a mouthpiece 18 in abutting coaxial alignment. As shown in FIG. 1, the aerosol-forming substrate 10, transfer element 12, aerosol-cooling element 14, spacer element 16 and mouthpiece 18 and a rear portion of the blind combustible heat source 4 are wrapped in an outer wrapper 20 of sheet material such as, for example, cigarette paper.

The combustible carbonaceous heat source 4 is a blind carbonaceous combustible heat source and is located at the distal end of the smoking article 2. As shown in FIG. 1, a non-combustible substantially air impermeable barrier 22 in the form of a disc of aluminium foil is provided between the rear end face 8 of the combustible carbonaceous heat source 4 and the aerosol-forming substrate 10. The barrier 22 is applied to the rear end face 8 of the combustible carbonaceous heat source 4 by pressing the disc of aluminium foil onto the rear end face 8 of the combustible carbonaceous heat source 4 and abuts the rear end face 8 of the combustible carbonaceous heat source 4 and the aerosol-forming substrate 10.

The aerosol-forming substrate 10 is located immediately downstream of the barrier 22 applied to the rear end face 8 of the combustible carbonaceous heat source 4. The aerosol-forming substrate 10 comprises a cylindrical plug of homogenised tobacco-based material 24 including an aerosol former such as, for example, glycerine, wrapped in plug wrap 26.

The transfer element 12 is located immediately downstream of the aerosol-forming substrate 10 and comprises a cylindrical open-ended hollow cellulose acetate tube 28.

The aerosol-cooling element 14 is located immediately downstream of the transfer element 12 and comprises a gathered sheet of biodegradable polymeric material such as, for example, polylactic acid.

The spacer element 16 is located immediately downstream of the aerosol-cooling element 14 and comprises a cylindrical open-ended hollow paper or cardboard tube.

The mouthpiece 18 is located immediately downstream of the spacer element 16. As shown in FIG. 1, the mouthpiece 18 is located at the proximal end of the smoking article 2 and comprises a cylindrical plug of suitable filtration material 30 such as, for example, cellulose acetate tow of very low filtration efficiency, wrapped in filter plug wrap 32.

The smoking article may further comprise a band of tipping paper (not shown) circumscribing a downstream end portion of the outer wrapper 20.

As shown in FIG. 1, the smoking article 2 further comprises a heat-conducting element 34 of suitable material such as, for example, aluminium foil, around and in direct contact with a rear portion **4*b* of the blind combustible heat source 4 and a front portion 10*a* of the aerosol-forming substrate 10. In the smoking article 2 according to the first embodiment of the invention shown in FIG. 1, the aerosol-forming substrate 10 extends downstream beyond the heat-conducting element 34. That is, the heat-conducting element 34 is not around and in direct contact with a rear portion of the aerosol-forming substrate 10. However, it will be appreciated that in other embodiments of the invention (not shown), the heat-conducting element 34 may be around and in contact with the entire length of the aerosol-forming substrate 10. It will also be appreciated that in other embodiments of the invention (not shown), one or more additional heat-conducting elements may be provided that overlie the heat-conducting element 34**.

The smoking article 2 according to the first embodiment of the invention comprises one or more first air inlets 36 around the periphery of the aerosol-forming substrate 10. As shown in FIG. 1, a circumferential arrangement of first air inlets 36 is provided in the plug wrap 26 of the aerosol-forming substrate 10 and the overlying outer wrapper 20 to admit cool air (shown by dotted arrows in FIG. 1) into the aerosol-forming substrate 10.

Figure 2:
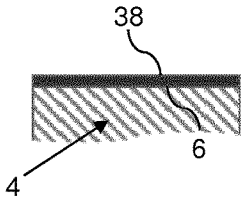
FIG. 2 shows a schematic transverse cross-section of a front portion of the combustible carbonaceous heat source of the smoking article according to the first embodiment shown in FIG. 1.

As shown in FIGS. 1 and 2, a layer of ignitable composition 38 is provided on the entire front end face 6 of the combustible carbonaceous heat source 4. The layer of ignitable composition 38 may be applied to the front end face 6 of the combustible carbonaceous heat source 4 by dipping the front end face of the combustible carbonaceous heat source in a solution or suspension of the ignitable composition or by brushing or spray-coating a solution or suspension of the ignitable composition onto the front end face of the combustible carbonaceous heat source. Alternatively, the layer of ignitable composition 38 may be formed by pressing the ignitable composition onto the front end face 6 of the combustible carbonaceous heat source 4.

In use, a user ignites the ignitable composition 38 by striking the front end face 6 of the combustible carbonaceous heat source 4 of the smoking article 2 according to the first embodiment of the invention on a frictional surface, which ignites the combustible carbonaceous heat source 4. Once the combustible carbonaceous heat source 4 is ignited the user draws on the mouthpiece 18 of the smoking article 2. When a user draws on the mouthpiece 18, cool air (shown by dotted arrows in FIG. 1) is drawn into the aerosol-forming substrate 10 of the smoking article 2 through the first air inlets 36.

The front portion **10*a* of the aerosol-forming substrate 10 is heated by conduction through the rear end face 8 of the combustible carbonaceous heat source 4 and the barrier 22 and the heat-conducting element 34**.

The heating of the aerosol-forming substrate 10 by conduction releases glycerine and other volatile and semi-volatile compounds from the plug of homogenised tobacco-based material 24. The compounds released from the aerosol-forming substrate 10 form an aerosol that is entrained in the air drawn into the aerosol-forming substrate 10 of the smoking article 2 through the first air inlets 36 as it flows through the aerosol-forming substrate 10. The drawn air and entrained aerosol (shown by dashed arrows in FIG. 1) pass downstream through the interior of the cylindrical open-ended hollow cellulose acetate tube 28 of the transfer element 12, the aerosol-cooling element 14 and the spacer element 16, where they cool and condense. The cooled drawn air and entrained aerosol pass downstream through the mouthpiece 18 and are delivered to the user through the proximal end of the smoking article 2 according to the first embodiment of the invention. The non-combustible substantially air impermeable barrier 22 on the rear end face 8 of the combustible carbonaceous heat source 4 isolates the combustible carbonaceous heat source 4 from air drawn through the smoking article 2 such that, in use, air drawn through the smoking article 2 does not come into direct contact with the combustible carbonaceous heat source 4.

The ignitable composition 38 provided on the front end face 6 of the combustible carbonaceous heat source 4 is also isolated from the airflow pathway along which air is drawn through the smoking article 2 according to the first embodiment of the invention for inhalation by a user such that, in use, air drawn along the airflow pathway does not directly contact the ignitable composition 38.

Figure 3:
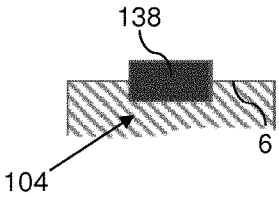
FIG. 3 shows a schematic transverse cross-section of a front portion of the combustible carbonaceous heat source of a smoking article according to a second embodiment.

The smoking article according to the second embodiment of the invention is of similar construction to the smoking article 2 according to the first embodiment of the invention shown in FIG. 1. However, as shown in FIG. 3, in the smoking article according to the second embodiment of the invention a disk of ignitable composition 38 is provided in a central portion of the front end face 6 of the combustible carbonaceous heat source 104 thereof. The combustible carbonaceous heat source 104 of the smoking article according to the second embodiment of the invention may be formed with the disk of ignitable composition provided in a central portion of the front end face 6 thereof using rotary pressing technology.

Figure 4:
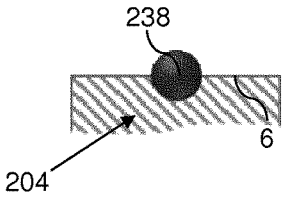
FIG. 4 shows a schematic transverse cross-section of a front portion of the combustible carbonaceous heat source of a smoking article according to a third embodiment.

The smoking article according to the third embodiment of the invention is also of similar construction to the smoking article 2 according to the first embodiment of the invention shown in FIG. 1. However, as shown in FIG. 4, in the smoking article according to the third embodiment of the invention a sphere of ignitable composition 238 is provided in a central portion of the front end face 6 of the combustible carbonaceous heat source 204 thereof. The combustible carbonaceous heat source 204 of the smoking article according to the third embodiment of the invention may be formed with the sphere of ignitable composition provided in a central portion of the front end face 6 thereof using rotary pressing technology.

Figure 5:
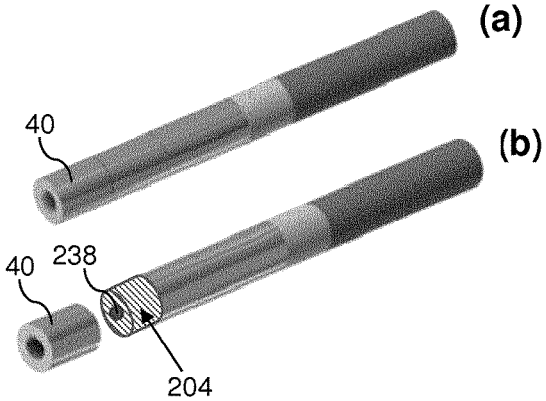
FIGS. 5(*a*) and (*b*) show perspective views of a smoking article according to a fourth embodiment.

The smoking article according to the fourth embodiment of the invention shown in FIGS. 5(*a*) and 5(*b*) is of similar construction to the smoking article according to the third embodiment of the invention. However, as shown in FIG. 5(*a*), the smoking article according to the fourth embodiment further comprises a cap 40 at the distal end thereof, which covers the combustible carbonaceous heat source 204. As shown in FIG. 5(*b*), the cap is removable to expose the sphere of ignitable composition 238 provided in the central portion of the front end face 6 of the combustible carbonaceous heat source 204 prior to use of the smoking article.

The specific embodiments and examples described above illustrate but do not limit the invention. It is to be understood that other embodiments of the invention may be made and the specific embodiments and examples described herein are not exhaustive.

The invention claimed is:

1. A smoking article, comprising:

a combustible carbonaceous heat source having opposed front and rear end faces;

an aerosol-forming substrate downstream of the rear end face of the combustible carbonaceous heat source;

an ignitable composition provided on at least a portion of the front end face of the combustible carbonaceous heat source; and one or more airflow pathways configured to allow air to be drawn through the smoking article for inhalation, wherein the ignitable composition is configured to be ignited by striking the front end face of the combustible carbonaceous heat source on a frictional surface, and wherein the ignitable composition is isolated from the one or more airflow pathways such that air drawn along the one or more airflow pathways does not directly contact the ignitable composition.

2. The smoking article according to claim 1, wherein the ignitable composition is in direct contact with the combustible carbonaceous heat source.

3. The smoking article according to claim 1, wherein the ignitable composition is provided on only a portion of the combustible carbonaceous heat source.

4. The smoking article according to claim 1, wherein the ignitable composition is provided on only a portion of the front end face of the combustible carbonaceous heat source.

5. The smoking article according to claim 4, wherein the ignitable composition is provided on only a central portion of the front end face of the combustible carbonaceous heat source.

6. The smoking article according to claim 1, wherein the ignitable composition is only provided on the front end face of the combustible carbonaceous heat source.

7. The smoking article according to claim 1, wherein the ignitable composition is configured to be ignited by striking the front end face of the combustible carbonaceous heat source on a cooperating striking surface.

8. The smoking article according to claim 7, wherein the cooperating striking surface comprises red phosphorous.

9. The smoking article according to claim 1, further comprising a cap configured to at least partially cover the front end face of the combustible carbonaceous heat source, wherein the cap being removable and configured to expose the front end face of the combustible carbonaceous heat source.

10. The smoking article according to claim 1, wherein the combustible carbonaceous heat source is a blind combustible carbonaceous heat source.

11. The smoking article according to claim 1, wherein the combustible carbonaceous heat source comprises an ignition aid.

12. The smoking article according to claim 11, wherein the ignition aid is an oxidizing agent.

13. The smoking article according to claim 1, further comprising one or more first air inlets disposed around the periphery of the aerosol-forming substrate.

14. The smoking article according to claim 1, further comprising a non-combustible substantially air impermeable barrier between the rear end face of the combustible carbonaceous heat source and the aerosol-forming substrate.

15. A container of smoking articles, comprising:

a plurality of smoking articles according to claim 1; and a cooperating striking surface, wherein the ignitable composition is provided on at least a portion of the front end face of the combustible carbonaceous heat source of each of the plurality of smoking articles is configured to be ignited by striking the front end face of the combustible carbonaceous heat source on a cooperating striking surface.

* * * * *